US005890033A

United States Patent [19]

Parker

[11] Patent Number: 5,890,033

[45] Date of Patent: Mar. 30, 1999

[54] DEVELOPER HOUSING HEATER USING A CENTRALLY HEATED MIXING AUGER

[75] Inventor: Delmer G. Parker, Rochester, N.Y.

[73] Assignee: Xerox Corporation, Stamford, Conn.

[21] Appl. No.: 963,209

[22] Filed: Nov. 3, 1997

[51] Int. Cl.[6] ..... G03G 15/08; G03G 21/20

[52] U.S. Cl. ..... 399/94; 399/97; 399/256

[58] Field of Search ..... 399/94, 97, 254, 399/256

[56] References Cited

U.S. PATENT DOCUMENTS 4,027,621 6/1977 Kane et al. ..... 399/97 X 5,442,423 8/1995 Edmunds et al. ..... 399/256 X 5,701,550 12/1997 Lofftus et al. ..... 399/97 X

FOREIGN PATENT DOCUMENTS 4-29171 1/1992 Japan .

*Primary Examiner*—Fred L. Braun

[57] ABSTRACT

Developer material, in a machine that has been idle in a cold, high relative humidity environment, is moved into an acceptable operating temperature/RH realm by warming the developer as it comes into contact with heated mixing augers. The augers are heated internally with a plurality of resistors.

6 Claims, 3 Drawing Sheets

DEVELOPER HOUSING HEATER USING A CENTRALLY HEATED MIXING AUGER

BACKGROUND OF THE INVENTION

This invention relates generally to electrophotographic printing, and more particularly, it is directed to a developer auger which is used in a development system of an electrophotographic printing machine.

The features of the present invention may be used in the printing arts and, more particularly, in electrophotographic imaging machines. In the process of electrophotographic image formation, a photoconductive surface is charged to a substantially uniform potential. The photoconductive surface is selectively exposed to record an electrostatic latent image corresponding to the informational areas of an original document being reproduced. Thereafter, a developer is transported into contact with the electrostatic latent image. Generally, the developer consists of toner particles adhering triboelectrically to carrier granules. The toner particles are attracted from the carrier granules of the developer onto the latent image. The resultant toner particle image is then transferred from the photoconductive surface to a final substrate such as plain paper and permanently affixed thereto.

Vagaries induced into the xerographic process by excursions in temperature and relative humidity (RH) create well known problems. While most high speed xerographic electronic printers operate in relatively well controlled environments, many printers and copier /duplicators do not. Even printers designed for a relatively benign computer room environment (4850™ for example) are required (specified) to work reliably over an environmental range between 80° F./80% RH and 60° F./10%.

A change in temperature can alter the sensitivity of a photoreceptor's Photoinduced Discharge Curve (PIDC). More exposure energy is required to discharge a cold photoreceptor compared to the same photoreceptor at a higher temperature. Consequently, less exposure is needed if a cold photoreceptor is warmed to a higher temperature by an electrical blanket heater (U.S. Pat. No. 3,887,367).

Temperature also plays a role in establishing the relative humidity within the developer sump. Relative humidity in turn influences the developer's triboelectric charging properties. For example, when the relative humidity is high, toner charge to mass ratio (tribo) tends to be low, and conversely, high when the RH is low. Because the triboelectric charge on a toner particle tends become smaller as the toner concentration increases, toner concentration (TC) can be adjusted to compensate for humidity changes that might otherwise de-stabilize development Unfortunately, there are situations where this approach does not work.

Consider for example, a printer that has been operating in a warm, low RH environment (high TC) which is then is shut down and allowed to equilibrate in a cool, high RH, ambient environment. Because the TC is high, and the prevailing RH at start up is high, the resulting developer tribo charge will be low and tend to produce prints with over developed solid areas and high spurious background.

Normally, as the machine continues to run the problem will correct itself because the xerographic cavity warms up causing the relative humidity to fall, and/or the control system permits the toner concentration to run down to an appropriate tribo level. But, until the new tribo equilibrium is attained, print quality is likely to be unacceptable. Therefore, relying on normal toner consumption to lower the TC as a means to adjust tribo may not always be an appropriate strategy for machines which have been idle for an extended period of time.

One countermeasure that has been proposed in the past to stabilize the xerographic process against operating extremes in temperature and humidity is to employ an external, electrically heated, developer housing blanket to warm the developer housing above ambient room temperature. The heating blanket elements can be activated or de-activated in response to a control circuit that monitors the development housing's temperature and/or humidity. This can be done whether the machine is running, or in standby (if the control circuits are powered). The external heating blanket can be deactivated when the heat generated during normal operation of the development housing warms the developer to, or above, some predetermined temperature.

A disadvantage of the external heating shroud is that because it heats from the outside inward, developer in the vicinity of the outer walls will be at a higher temperature than developer on the interior of the housing. Moreover, because the heating shroud is the warmest part of the housing, unless it is thermally insulated on the outside, a large portion of the heat it generates will be lost to the outside environment. A typical high speed printer or duplicator developer housing converts 50 to 90 watts of mechanical power into heat during normal operation. Without forced air cooling, the temperature inside the housing can easily rise to as much as 25° C. above ambient. In this case, insulation on the outside of the heating shroud acts as a thermal barrier and will impede the rate at which the housing can rid itself of excess heat.

BRIEF DESCRIPTION OF THE INVENTION

In accordance with the present invention, developer in a machine that has been idle in a cold, high relative humidity environment is moved into an acceptable operating temperature/RH realm by warming the developer as it comes into contact with heated mixing augers. The augers are heated internally with a string of resistors.

Many powder development systems employ one or more transport augers to circulate developer for the purpose of promoting toner blending and cross mixing. In a well designed development system all the developer periodically passes through the auger system. In some cases, this occurs as frequently as every three seconds or less. Hence, if the temperature of the developer is raised by contacting an electrically heated auger as the developer passes through the auger channel heat will be quickly distributed throughout the entire developer sump. Furthermore, heat will be distributed uniformly because the developer tumbles and mixes while it is in intimate contact with the thermally conductive auger blades and support shaft. Functionally the developer acts like a fluid to cool the heated auger members. Because developer passes through the auger channel quickly, the auger can be operated at a relatively high temperature to make the heat transfer process more efficient without danger of overheating the toner.

DETAILED DESCRIPTION OF THE PREFERRED EMBODIMENT(S) OF THE INVENTION

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 3:
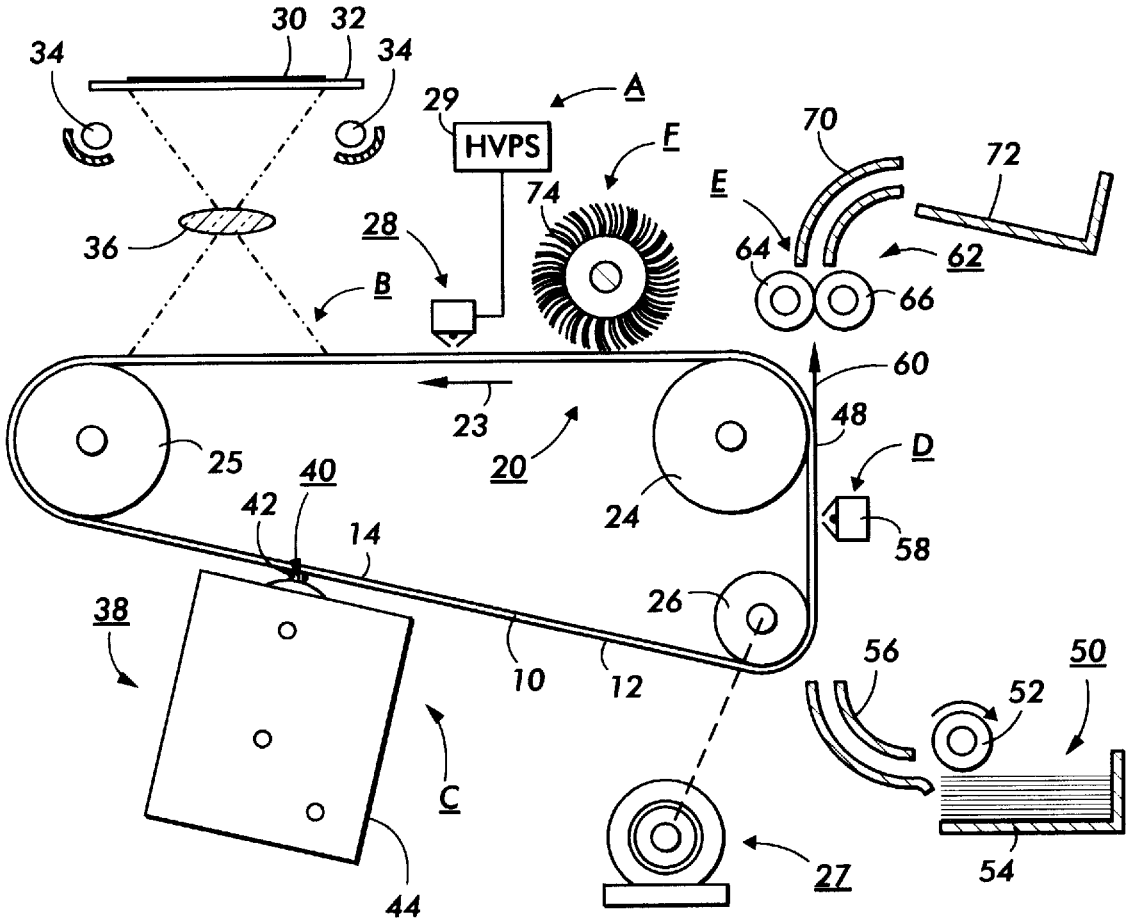
FIG. 3 is a schematic illustration of a system architecture in which the auger structure of FIG. 2 may be utilized.

Inasmuch as the art of electrophotographic printing is well known, the various processing stations employed in the printing machine illustrated in FIG. 3 will be shown schematically and their operation described briefly with reference thereto.

Referring initially to FIG. 3, there is shown an illustrative electrophotographic imaging machine incorporating the development apparatus of the present invention therein. The electrophotographic printing machine employs a belt 10 having a photoconductive surface 12 deposited on a conductive substrate. Preferably, photoconductive surface 12 is made from a selenium alloy. The conductive substrate is made preferably from an aluminum alloy which is electrically grounded. Belt 10 moves in the direction of arrow 23 to advance successful portions of photoconductive surface 12 sequentially through the various processing stations disposed about the path of movement thereon. Belt 10 is entrained about stripping roller 24, tensioning roller 25 and drive roller 26. Drive roller 26 is mounted rotatably in engagement with belt 10. Motor 27 rotates roller 26 to advance belt 10 in the direction of arrow 23. Roller 26 is coupled to motor 27 by suitable means such as a drive belt. Belt 10 is maintained in tension by a pair of springs (not shown) resiliently urging tensioning roller 24 against belt 10 with the desired spring force. Stripping roller 24 and tensioning roller 25 are mounted to rotate freely.

Initially, a portion of belt 10 passes through charging station A. At charging station A, a corona generating device, indicated generally by the reference numeral 28, charges photoconductive surface 12 to a relatively high, substantially uniform potential. High voltage power supply 29 is coupled to corona generating device 28. Excitation of power supply 29 causes corona generating device 28 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses the light image onto the charged portion of photoconductive surface 12 to selectively dissipate the charge thereon. This records an electrostatic latent image on photoconductive surface 12 which corresponds to the informational areas contained within original document 30. One skilled in the art will appreciate that in lieu of a light lens system, a raster output scanner (ROS) may be employed. The raster output scanner uses a modulated laser light beam to selectively discharge the charged photoconductive surface 12 as to record the latent image thereon. In the event a printing system is being employed, the modulation of the ROS is controlled by an electronic subsystem coupled to a computer. Alternatively, in the event a digital copier is being used, a raster input scanner may scan an original document to convert the information contained therein to digital format which, in turn, is employed to control the ROS.

After the electrostatic latent image has been recorded on photoconductive surface 12, belt 10 advances the latent image to development station C. At development station C, a developer unit, indicated generally by the reference numeral 38, develops the latent image recorded on the photoconductive surface. Developer unit 38 includes donor roller 40 and electrode wires 42. Electrode wires 42 are electrically biased relative to donor roll 40 to detach toner therefrom so as to form a toner powder cloud in the gap between the donor roll and the photoconductive surface. The latent image attracts toner particles from the toner powder cloud forming a toner powder image thereon. Donor roller 40 is mounted, at least partially, in the chamber of developer housing 44. The chamber in developer housing 44 stores a supply of developer material. The developer material is two component developer material having at least carrier granules with toner particles adhering triboelectrically thereto. A magnetic roller disposed internally of the chamber of housing 44 conveys the developer material to the donor roller. The magnetic roller is electrically biased relative to the donor roller so that the toner particles are attracted from the magnetic roller to the donor roller. Features of the developer unit 38 will be discussed hereinafter, in greater detail, with reference to FIGS. 1 and 3, inclusive.

With continued reference to FIG. 3, after the electrostatic latent image is developed, belt 10 advances the toner powder image to transfer station D. A copy sheet 48 is advanced to transfer station D by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image developed thereon contacts the advancing sheet at transfer station D. Transfer station D includes a corona generating device 58 which sprays ions onto the backside of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

Fusing station E includes a fuser assembly indicated generally by the reference numeral 62 which permanently affixes the transferred powder image to sheet 48. Fuser assembly 62 includes a heated fuser roller 64 and backup roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 70 to catch tray 72 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 74 in contact with photoconductive surface 12. The particles are cleaned from photoconductive surface 12 by the rotation of brush 74 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the developer unit of the present invention therein.

Figure 1:
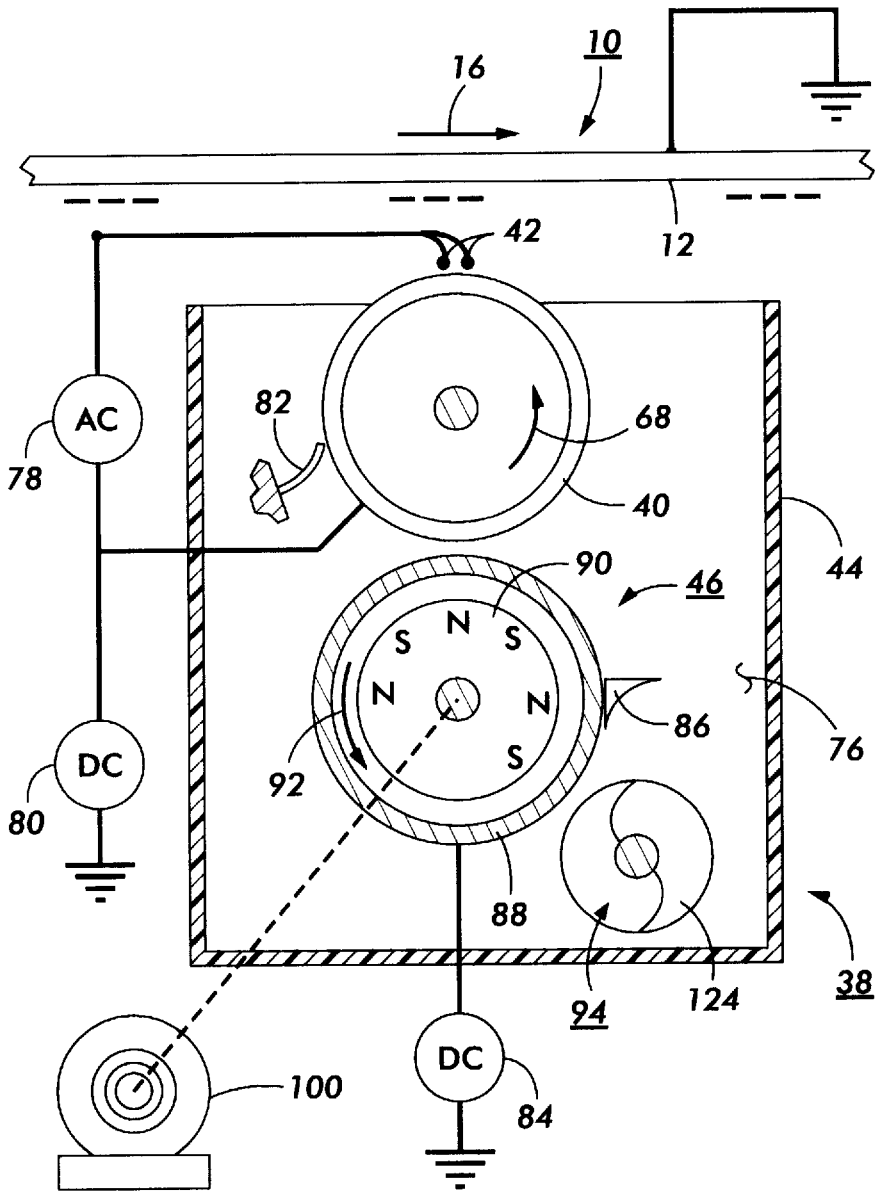
FIG. 1 is a schematic illustration of a developer donor system.

Referring now to FIG. 1, developer unit 38 is illustrated in greater detail. As shown therein, developer unit 38 includes a housing 44 defining a chamber 76 for storing a supply of developer material therein. Donor roller 40, electrode wires 42 and magnetic roller 46 are mounted in chamber 76 of housing 44. Donor roller 40 can be rotated in either the "with" or "against" direction relative to the direction of motion of belt 10. In FIG. 1, donor roll 40 is rotating in the direction of arrow 68. Similarly, the magnetic roller can be rotated in either the "with" or "against" direction relative to the direction of motion of belt 10. In FIG. 1, magnetic roller 46 is rotating in the direction of arrow 92. Donor roller 40 is preferably made from an anodized aluminum or ceramic coated aluminum.

Developer unit 38 also has electrode wires 42 which are located in the space between photoreceptor 12 and donor roll 40. A plurality of electrode wires are shown which extend in a direction substantially parallel to the longitudinal axis of the donor roll. The electrode wires are made from one or more thin (i.e. 50 to 100 micron diameter) stainless steal wires which are closely spaced and in contact with donor roll 40. The wires are maintained in tension. The extremities of the wires are supported so as to maintain the desired tension with the wires being slightly below or tangent to the surface of the donor roll. An electroded donor roll could be utilized in lieu of the roll 40 and wires 42.

As illustrated in FIG. 1, an alternating electrical bias is applied to the electrode wire by an AC voltage source 78. The applied AC voltage establishes an alternating electrostatic field between the wires and the donor roller which is effective in detaching toner from the donor roller and forming a toner powder cloud about the wires. The magnitude of the AC voltage is relatively low and in the order of 200 to 500 volts peak at a frequency ranging from about 3 kHz to about 10 kHz. A DC bias supply 80 which applies approximately 300 volts to donor roll 40 establishes an electrostatic field between photoconductive surface 12 of belt 10 and donor roll 40 for attracting the detached toner particles from the toner cloud surrounding the wires to the latent image recorded on the photoconductive member. A cleaning blade 82 strips all of the toner from donor roller 40 at development so that magnetic roller 46 meters fresh toner to a clean donor roll. Magnetic roller 46 meters a constant quantity of toner having a substantially constant charge onto donor roller 40. This ensures that the donor roller provides a constant amount of toner having a substantially constant charge in the development gap. In lieu of using a cleaning blade, the combination of donor roller spacing, i.e. spacing between the donor roller and the magnetic roller, the compressed pile height of the developer material on the magnetic roller, and the magnetic properties of the magnetic roller, in conjunction with the use of a conductive, magnetic developer material achieves the deposition of a constant quantity of toner having a substantially constant charge on the donor roll. A DC bias supply 84 which applies approximately 100 volts to magnetic roller 46 establishes an electrostatic field between magnetic roller 46 and donor roller 40 which causes toner particles to be attracted from the magnetic roller to the donor roller. Metering blade 86 is positioned closely adjacent to magnetic roller 46 to maintain the compressed pile height of the developer material on magnetic roller 46 at the desired level. Magnetic roller 46 includes a non-magnetic tubular member 88 made preferably from aluminum and having the exterior circumferential surface roughened. An elongated magnet 90 is positioned internal to, and spaced from the tubular member. The magnet is stationary. The tubular member rotates in the direction arrow 92 to advance the developer material adhering thereto into the nip defined by donor roller 40 and magnetic roller 46. Motor 27 causes non-magnetic tubular member 88 to rotate in the direction of arrow 92. Toner particles are attracted from the carrier granules on the magnetic roller to the donor roller.

Figure 2:
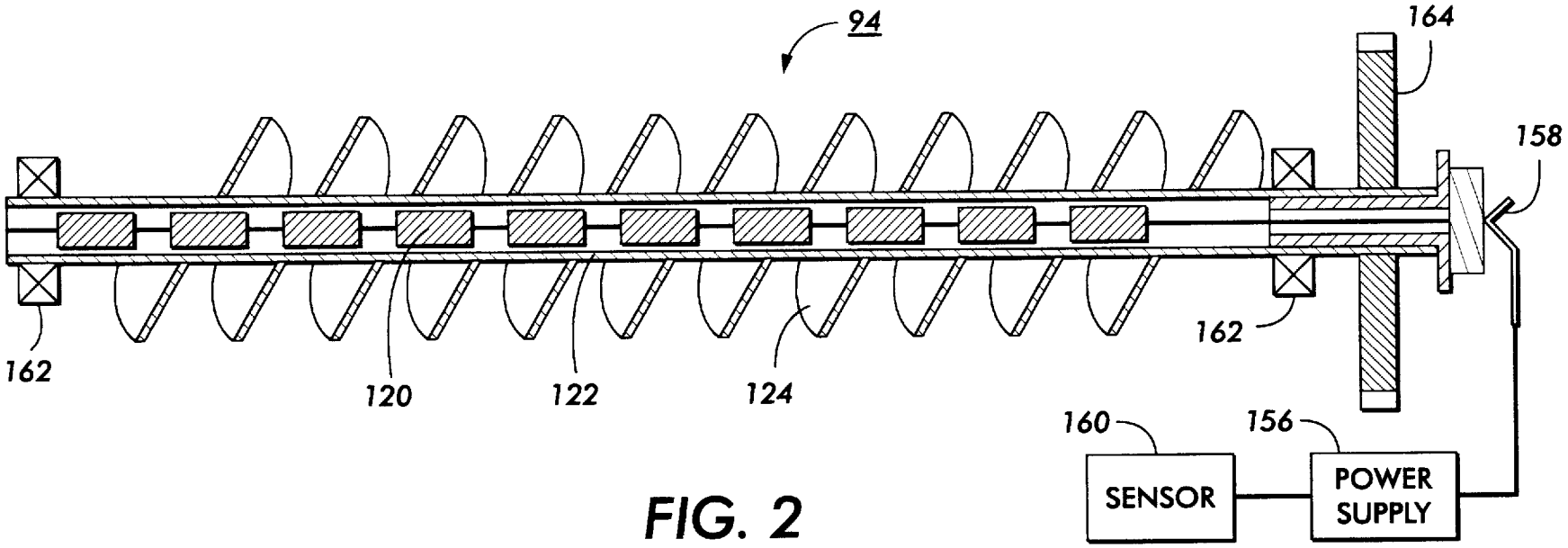
FIG. 2 is a schematic illustration of an auger structure incorporating features the invention.

With continued reference to FIG. 1, an auger, indicated generally by the reference numeral 94, is located in chamber 76 of housing 44. Auger 94 is mounted rotatably in chamber 76 to mix and move the developer laterally. The auger, as shown in FIG. 2, has a blade that extends spirally along the shaft. The blade is designed to advance the developer material in a axial direction substantially parallel to the longitudinal axis of the shaft.

As successive electrostatic latent images are developed, the toner particles within the developer material are depleted. A toner dispenser (not shown) stores a supply of toner particles. The toner dispenser is in communication with chamber 76 of housing 44. As the concentration of toner particles in the developer diminishes, fresh toner particles are introduced into the developer chamber from the toner dispenser. The auger in the chamber of the housing mixes the fresh toner particles with the remaining developer so that the resultant developer is substantially homogeneous. In this way, a substantially constant number of toner particles are in the chamber of the developer housing at any time and with the same average charge on each toner particle. The developer in the chamber of the housing is magnetic and may be electrically conductive. By way of example, the carrier granules include a ferromagnetic core coated with a non continuous layer of resinous material. The toner particles are made from a resinous material, such as a vinyl polymer, mixed with a coloring material such as chromogen black. The developer is comprised of from between about 90% to about 99% by weight of carrier and from 10% to about 1% by weight of toner. However, one skilled in the art will recognize that any other suitable developer material may be used.

Developer in a machine that has been idle in a cold, high relative humidity environment is moved into an acceptable operating temperature/RH realm by warming the developer as it comes into contact with heated mixing augers. The augers are heated internally by a string of resistors.

FIG. 2 illustrates a plurality of resistors 120 disposed inside a hollow tubular shaft 122 forming a part of the auger 94. The function of the resistors is to generate the heat that the auger transfers to the developer for the aforementioned purpose. The tubular shaft is preferably made out of aluminum. A helical blade or flange structure 124 integral with the tubular shaft serves to move developer toward an auger exit while simultaneously promoting triboelectric charging between the carrier beads and toner particles while mixing thereof.

A standard two watt carbon resistor has a diameter of ~0.3 inches and is ~0.7 inches long. Allowing space for connections, each resistor will take up about one inch of space axially along the auger shaft. In this arrangement, the heating capacity is two watts per inch, or 20 watts for a 10 inch long auger. The bore diameter of the auger shaft is chosen so that the resistors fit snugly inside. A snug fit ensures good thermal contact is made between the auger shaft and resistor assembly. Because the heat conducted away by the augers cools the resistors the actual power dissipation can be greater than rated two watts/resistor.

Another advantage of the resistor heating element is that the resistor's resistance can be chosen to match any ac or dc power source. For example, if the distribution system is 36 volts dc, and the resistor string consists of 10 two watt resistors, then each resistor's resistance, R, should be=$E^2/P$ or ~65 ohms. Resistance values to accommodate other source voltages can be determined in a like fashion. Likewise, resistors with different physical dimensions and power dissipation ratings can be used to accommodate different size augers Other resistive elements could be substituted for the resistor string (wire for example), but the simple resistor arrangement has the advantage that is inexpensive, efficient and it's composition body provides electrical isolation between the heating power supply and the auger.

Power to heat the resistor string from power supply 156 is easily commutated through the ends of the auger shaft with a spring contact 158 as illustrated in FIG. 2. The heater circuit can be energized in response to a humidity sensing element 160 that also initiates the machine's logic to set the developer housing into an idle or a run condition so that developer circulates through the auger system. The sensor and it's associated logic can be operated from a lithium, or some other type battery supply to eliminate the need for line power in the standby mode. The machine's logic could also be programmed to disable the warm up cycle during weekends or over night if so desired. After the auger heater, abetted by the mechanical power dissipated by the development housing, warms the developer to a predetermined temperature/humidity realm, the auger heater is disconnected until it is needed again.

Suitable bearing members 162 are provided for operatively supporting the auger structure 94. A gear 164 supported by the shaft 120 of the auger structure is provided for rotating the auger structure. To this end the gear is operatively coupled to a drive mechanism, not shown.

I claim:

1. A development apparatus for developing toner images, comprising:

a supply of developer including toner;

an auger including a blade structure for simultaneously moving and mixing said supply of developer, the auger having electrical heater means disposed internally thereof; and a source of electrical power connectable to the heater means for elevating the temperature thereof for conditioning said developer to a predetermined operating realm.

2. Development apparatus according to claim 1, wherein said auger comprises a hollow shaft with the heater means disposed internally of the hollow shaft.

3. Development apparatus according to claim 2 wherein said heater means comprises a plurality of resistors.

4. Development apparatus according to claim 3 including structure for sensing the ambient conditions of said developer and effecting the supply of electrical power to said plurality of resistors.

5. Development apparatus according to claim 2 wherein the internal diameter of said hollow shaft is such that optimum thermal contact is provided between said plurality of resistors and said hollow shaft.

6. Development apparatus according to claim 3 wherein said resistors are standard two watt carbon resistors.

* * * * *